United States Patent [19]

Schueler

[11] 4,222,511

[45] Sep. 16, 1980

[54] LOW NOISE BURSTER

[75] Inventor: Marlin A. Schueler, San Leandro, Calif.

[73] Assignee: Swingline, Inc., New York, N.Y.

[21] Appl. No.: 949,019

[22] Filed: Oct. 6, 1978

[51] Int. Cl.[3] ..... B26F 3/02

[52] U.S. Cl. ..... 225/100; 225/4

[58] Field of Search ..... 225/100, 101, 106, 4, 225/5

[56] References Cited

U.S. PATENT DOCUMENTS

| | | | |
|---|---|---|---|
| 2,837,054 | 6/1958 | Eccher | 225/100 X |
| 3,146,927 | 9/1964 | Peterson | 225/100 |
| 3,191,832 | 6/1965 | Davies | 225/100 |
| 3,493,156 | 2/1970 | Absler et al. | 225/100 |
| 3,672,551 | 6/1972 | Peterson | 225/100 |
| 3,991,924 | 11/1976 | Schueler | 225/100 |
| 4,118,022 | 10/1978 | Rayfield et al. | 225/100 X |
| 4,131,272 | 12/1978 | Hartnig | 225/100 X |

*Primary Examiner*—Frank T. Yost

*Attorney, Agent, or Firm*—Pennie & Edmonds

[57] ABSTRACT

A burster for separating successive sheets of paper from a continuous web of paper has at least one output or draw roller having a larger diameter than the input or feed rollers with all of these rollers rotated at the same r.p.m. and a simple belt drive mounted on a pivotal double link with a one-to-one ratio provides for driving one set of rollers from the other set with an adjustable distance between sets of rollers.

3 Claims, 5 Drawing Figures

FIG-3
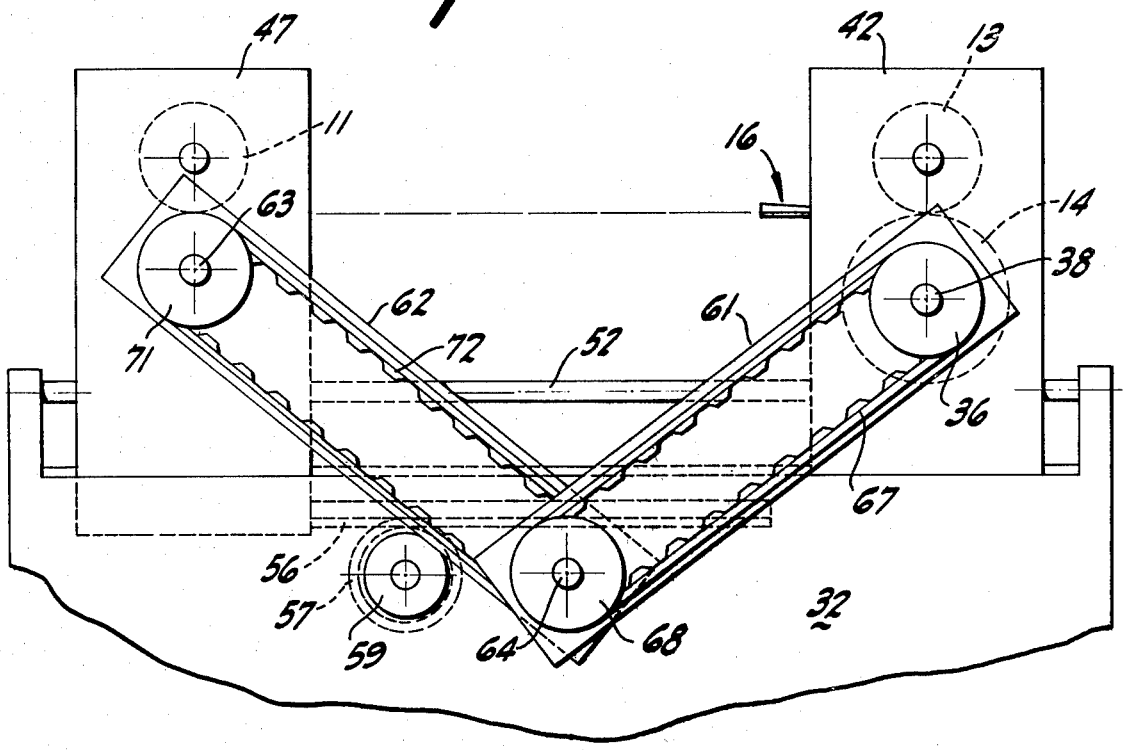
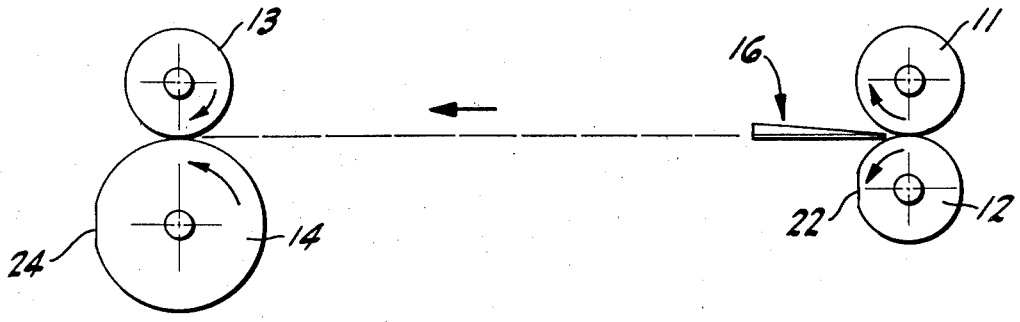
FIG-4

LOW NOISE BURSTER

BACKGROUND OF THE INVENTION

Conventional bursters are well known in the art, and are widely employed to separate the successive forms of stationery from a continuous web of stationery. Bursting is normally accomplished by feeding a web of paper or stationery through a first pair of input or feed roller which are rotated at a first rate and then feeding this web into engagement with a second pair of output or draw rollers rotating at a much greater rate than the input rollers, so that the leading edge of the web is gripped and yanked forward to tear the web laterally along perforations across the web. Commonly, some type of bar or rolls are provided at the location of the perforation to be torn or separated, as shown for example, in U.S. Pat. Nos. 2,803,304 and 3,161,335. An improvement in this respect is shown in U.S. patent application Ser. No. 922,744 by the present inventor. In accordance with this improvement, the speed of rotation of the output or draw rollers may be reduced to minimize the noise of bursting operations.

The rollers normally employed in bursters are formed of a rubber composition which as a practical matter can only be manufactured with some variation in dimensions. Thus it has been found necessary in the prior art to provide "flats", upon one of the feed rollers at least, in order to periodically release the grip thereof on the web so that the web will not be progressively fed at a small angle through the burster. With flats provided on an input roller, it is then also important to provide flats on an output roller, in order that the output rollers will not grip and yank the web forward when the web is not held by the input rollers. Under the latter circumstance, failure to separate a form or sheet from the web might occur or tearing of the web at some location other than the perforation might result.

With the provision of flats or planar surfaces on a roller of each pair of rollers in a burster, it then becomes necessary to rotate the pairs of rollers in synchronism and this causes certain problems when the physical separation of the pairs of rollers must be varied. It is common to provide bursters with the capability of bursting at adjustable distances along the web in order to accommodate forms or the like of different sizes. Conventionally, bursters are provided with relatively complicated mechanical motion drive means in order to satisfy the requirement of synchronous roller rotation and adjustable separation between pairs of rollers.

The present invention provides an improvement in bursters which materially simplifies the mechanical structure thereof.

SUMMARY OF INVENTION

The burster of the present invention provides for rotating the input or feed rollers at the same rate of rotation as one of the output or draw rollers despite the fact it is universally accepted that the output rollers must be rotated at a greater rate in order to burst a web of paper at lateral perforations thereacross. The foregoing is made possible in the present invention by the provision of one or both of the output or draw rollers with a greater diameter than the diameter of the feed rollers. While it has always been accepted that the draw rollers must be rotated more rapidly than feed rollers in order to provide a longitudinal force upon the web of paper for bursting, such is not actually the case. The present invention by providing at least one draw output or roller with a greater diameter produces a greater peripheral speed of movement at the draw roller, so that a web of paper gripped by the draw rollers will, in fact, be forcibly urged away from the feed rollers so as to burst the web of paper.

In addition to the foregoing, the present invention provides a materially simplified drive system for a burster which precludes the necessity of a complicated mechanical take-up system normally employed between pairs of rollers in a burster to accommodate adjustable separation of the pairs of rollers while maintaining synchronous roller drive. By rotating both pairs of rollers at the same rate, the present invention is thus capable of employing a simple pivotally-mounted double link system carrying a simple belt drive and have a one-to-one ratio so that synchronous roller rotation is attained without the necessity of a complicated mechanical take-up system. Consequently, the present invention provides a materially simplified construction for a highly advantageous burster.

The burster of the present invention employs rollers which may be formed of a rubber composition or the like for gripping a web of paper to be driven to the machine. Rollers formed of such materials cannot normally be manufactured to very close tolerances, and in order to minimize the cost and weight of the burster, it is generally accepted that the feed or input rollers may move the paper at some slight angle to the desired direction of web travel. In order to prevent difficulties that can arise from this situation, one input or feed roller is provided with a flat surface so that once each revolution thereof, the web of paper is released for a very short period of time so that the web may be realigned with the desired direction of movement. With the input roller so formed for the reasons noted above, it then follows that one of the output or draw rollers should be provided with a flat surface which is always located so that the draw rollers will not grip the paper at any time the feed rollers have released the paper. The foregoing is necessary in order to prevent the draw rollers at some time yanking the paper through the feed rollers when the feed rollers are not gripping the paper. Such a situation would move the perforation line of the web past the normal bursting point and any bursting element placed at the bursting point so that tearing of the web could subsequentially occur in some undesired location spaced from a lateral perforation line. Inasmuch as bursters are not normally manufactured to handle bursting operations at only fixed longitudinal web distances, it then follows that separation of the pairs of rollers at any distance unequal to roller circumference will eventually result in the draw rollers yanking the paper through the feed rollers when the latter are not gripping the web because of the flat on a feed roller unless the draw rollers are provided with corresponding flat surfaces which rotate in synchronism with the flat on the feed rollers.

DESCRIPTION OF FIGURES

The present invention is illustrated as to a single preferred embodiment thereof in the accompanied drawings, wherein:

FIG. 3 is a partial elevational view showing roller drive and adjusting means taken in the plane 3—3 of FIG. 1;

FIG. 4 is a schematic representation of pairs of rollers in the present invention illustrating the path of paper therethrough.

DESCRIPTION OF PREFERRED EMBODIMENTS

Figure 1:
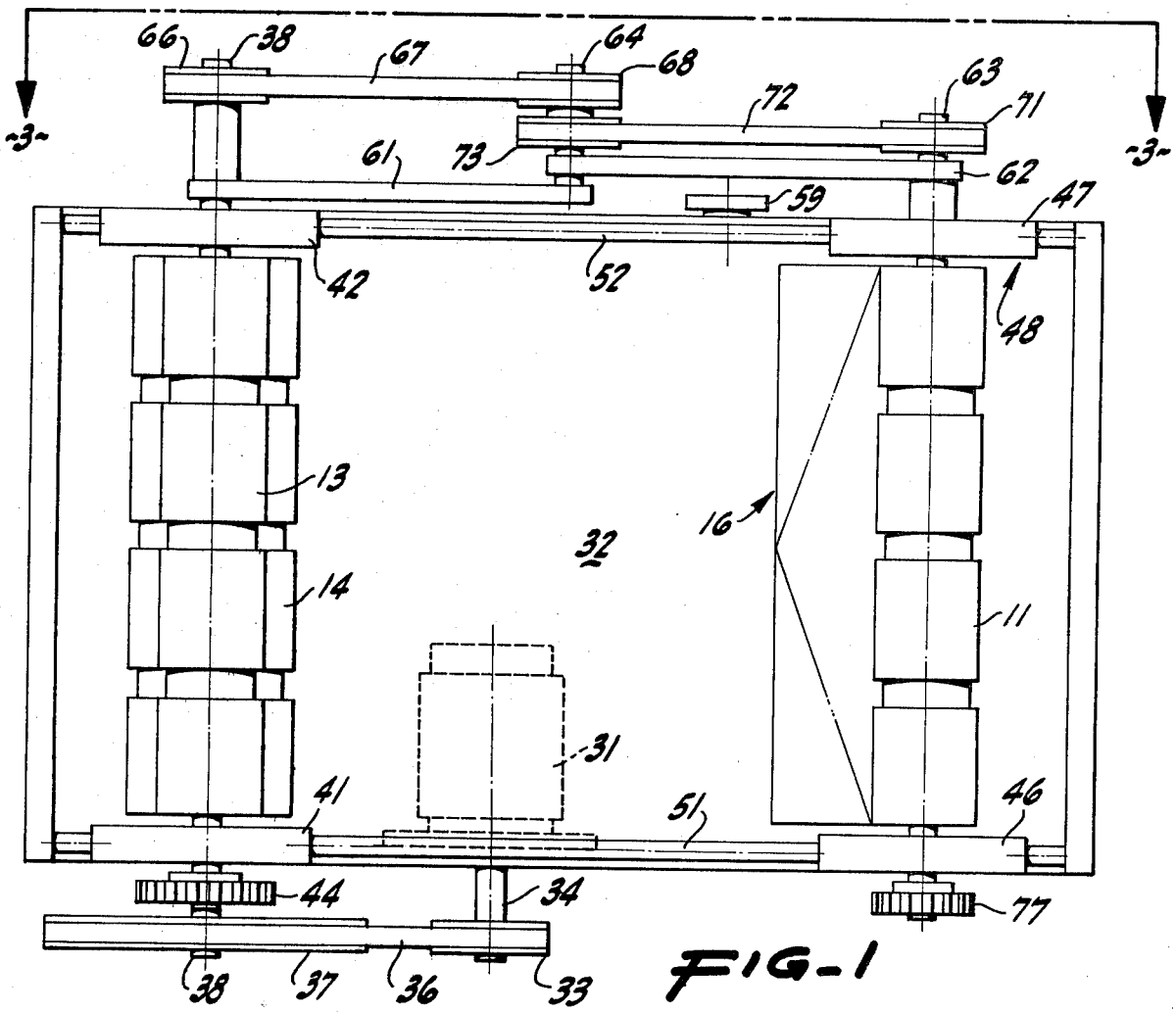
FIG. 1 is a top plan view of an improved burster in accordance with the present invention and having portions removed to show the relative location of operative elements.
Figure 2:
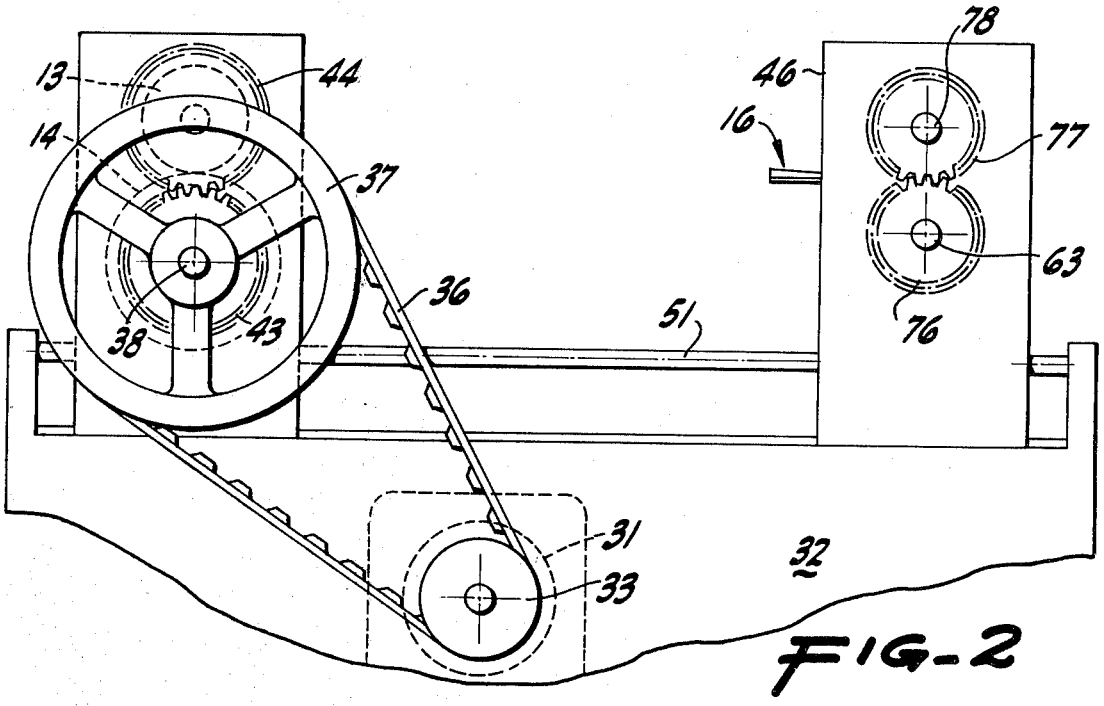
FIG. 2 is a partial side elevational view of the burster of FIG. 1.

The improved burster of the present invention includes many conventional elements of bursters, such as the frame, motor, and the like, which are consequently only partially illustrated herein and may include conventional additional elements, such as slitters, stackers, or the like which are not illustrated herein. Referring now to the drawings, it will be seen that there are provided a pair of input or feed rollers 11–12 adapted to grip and feed a web of paper or the like through the burster of the present invention. A second pair of output or draw rollers 13–14 is disposed at an adjustable distance from the feed rollers 11–12. The rollers of each pair of rollers contact each other and are preferably formed of a rubber composition or the like, for gripping paper passed therebetween. The pairs of rollers are driven to be rotated as indicated, for example, in FIG. 4.

Conventionally, the draw rollers 13 and 14 are rotated much more rapidly than the feed rollers so that upon gripping of the leading edge of a web of paper, the draw rollers will yank the paper away from the feed rollers so as to rip the paper laterally thereacross at a perforation line whereat some type of breaking or bursting element is located. The present invention employs a breaking element 16 such as illustrated, for example in my co-pending U.S. patent application Ser. No. 922,744 entitled "IMPROVED BURSTER". Reference is made to the above-noted patent application for details of bursting operations employing this improved bursting element and for description of the element itself. It is, however, noted that with the use of this improved breaking element, it is possible for the output or draw rollers to be rotated slower than is conventional, and it is noted further that such output rollers may be rotated at about 1.5 times the rate of the feed rollers.

Contrary to accepted practice in the art of bursters, the present invention operates to rotate the rollers of the inlet pair and one of the rollers of the outlet pair at the same rate i.e. the same rpm. The requisite gripping and acceleration of the leading edge of the web for bursting of the web is herein accomplished by forming at least one of the output or draw rollers 14 with a larger diameter than the diameters of the feed rollers 11 and 12. With the draw roller 14 having a larger diameter than the feed rollers and being rotated at the same r.p.m. it will be appreciated that this output roller 14 has a greater linear velocity of the periphery thereof than that of the feed rollers, and consequently, when the leading edge of a web is forcibly engaged with this periphery, it will be drawn away from the feed rollers at a much greater rate than the web is fed by the feed rollers, so that bursting of the web will occur at the breaker element. In actuality, either or both of the output or draw rollers 13–14 may be formed with a greater diameter than the diameter of the feed rollers, however, in the illustrated embodiment of the present invention, only roller 14 is formed with a larger diameter. In the foregoing example of rotating draw rollers at 1.5 times the rate of rotation of the feed rollers, the present invention would provide the draw roller 14 with a diameter that is 1.5 times the diameter of the feed rollers to produce substantially the same effect upon the web of paper.

The rollers of the present invention, in common with the rollers of other bursters are commonly formed of a rubber composition or the like, for maximum gripping of paper passed between pairs of rollers. These rollers may be formed with longitudinally spaced circumferential depressions, however, it is noted that the unavoidable tolerances in roller dimensions tend to introduce misdirection of a web of paper passing through the feed rollers. The slightest misalignment of a web passed through the feed rollers will produce a progressive error in the direction of feed unless corrected. Such correction is normally accomplished by the provision of flat surfaces on the feed rollers. This is illustrated in FIG. 4 of the drawings, for example, by a flat surface 22 on the roller 12. The flat surface 22 provides for instantaneously releasing the web of paper passed between the feed rollers so that any misalignment may be readily corrected.

Although the provision of flat surfaces on one or both of the feed rollers is known to solve the problem of web misalignment in passage through the burster, this solution raises a further problem. At the time the draw rollers 13 and 14 grip the leading edge of the web, it is necessary that the feed rollers be gripping the web so that a bursting force is applied to the web for tearing the web laterally across the perforations at the breaker element. If, by chance, the draw rollers 13 and 14 grip the leading edge of the web at a time that the feed rollers are not gripping the web because the flat surface 22 is facing the paper, the web will be rapidly drawn or yanked through the feed rollers without bursting so as to displace the perforation from the breaking element 16. When the feed rollers again grip the web, the draw rollers will yank the leading portion of the web so that the web will be torn at some location other than the perforation line.

It is to be appreciated that bursters are conventionally arranged to displace the contact point of the draw rollers a distance from the breaking element 16 which is equal to the longitudinal distance between perforation lines across the web. A solution to this secondary problem briefly noted above is the provision of a flat surface 24 on the draw roller 14, with a further provision that the draw roller 14 must always be rotated and synchronized with the feed roller 12, so that the flat surfaces 22 and 24 on the rollers 12 and 14 face the web of paper at the time instant. In this manner, the flat surface on the draw roller prevents gripping of the leading edge of the web during the brief instant that the feed rollers have released the paper. Although this release of the web is extremely shortlived, it is necessary first in order to prevent misalignment of the web in passing through the burster, and secondly, to prevent longitudinal misalignment of the perforation lines across the web with respect to the breaking element.

Synchronous orientation and rotation of the rollers of the pairs of rollers imposes certain limitations upon the drive means of bursters. Many conventional bursters provide for adjustable displacement between the breaking element and draw rollers. This adjustment is incorporated in order to provide the burster with the capability of bursting forms or sheets of different lengths from a continuous web of paper. The feed rollers and draw rollers of a burster are normally driven from a single motor with suitable gears and belts between the rollers for driving each of them. In order to maintain the above-noted requisite relationship of flat surfaces on feed rollers and draw rollers with an adjustable distance between these pairs of rollers, there is normally employed complicated mechanical linkages and take-up means in the drive systems of bursters. The present invention, on the other hand, precludes such complicated systems by the incorporation of wholly alternative means of accelerating the leading edge of a web of paper for bursting of the same.

The drive means of the present invention includes a motor 31 mounted on a frame 32 of the burster and having a pulley wheel 33 connected to the motor shaft 34. A cogged or toothed belt 36 extends about the pulley wheel 33 and a pulley wheel 37 mounted on the outer end of the shaft or axle 38 of the roller 14 with the belt positively engaging teeth on the pulley wheels. The shaft 38 is carried in bearings in spaced mounting plates 41 and 42 between which the roller 14 is disposed and adjacent the pulley wheel 37, the shaft 38 carries a gear 43 which engages a gear 44 on the axle of roller 13. It is noted at this point that the gears 43 and 44 have the different pitch diameters equal to the different diameters of rollers 13 and 14, and this is further discussed below. Roller 13 has the same diameter as feed rollers 11 and 12, however, roller 14 has a larger diameter, as for example, 1.5 times as large.

It will be seen from the foregoing that the motor 31 rotates the roller 14 which, in turn, rotates the roller 13 through the gears 43 and 44. Upon the opposite side of the burster, there is provided drive means for the rollers 11 and 12 and this is illustrated in FIGS. 1 and 3. The feed rollers 11 and 12 are mounted between a pair of mounting plates 46 and 47 which are connected together as a single unit 48 that, in turn, is mounted in sliding relation upon a pair of longitudinal rods 51 and 52. A rack 56 extends from the feed roller unit 48 toward the outlet end of the burster and engages a pinion 57 secured to a rotatably mounted shaft 58 having a knob 59 thereon for turning of the pinion to slide the feed roller unit 48 along the rods 51 and 52. By this means, the distance between the feed rollers and breaker unit 16 carried therewith and the draw rollers 13 and 14 may be adjusted.

Rotation of the feed rollers is very simply accomplished in the present invention by the provision of a pair of pivotally mounted links 61 and 62 and belt drives associated therewith. The link 61 is pivotally mounted on the axle 38 of roller 14 on the outside of mounting plate 42 and the link 62 is pivotally mounted on the axle 63 of feed roller 12 on the outside of mounting plate 47. The otherwise free ends of the links 61 and 62 are connected together by pivotally mounting same on a single shaft 64. A pulley wheel 66 on the shaft 38 is connected by a cogged or toothed belt 67 to a pulley wheel 68 mounted on the pivot shaft 64. Similarly, a pulley wheel 71 on the shaft 63 is connected by a cogged belt 72 to a pulley wheel 73 on the shaft 64. The toothed pulley wheels 68 and 73 are connected to rotate together.

As the distance between the feed rollers and draw rollers is adjusted, the links 61 and 62 will pivot to form a greater or lesser angle therebetween, and the pulley wheels 66 and 71 will remain connected by means of the belts 67 and 72 and intermediate pulley wheels 68 and 73. This adjustment will cause the rollers 12 and 14 to be rotated, but this rotation will be in synchronism inasmuch as there is a one-to-one drive ratio therebetween. All of the pulley wheels have the same diameters and the cogged belt connection between pulley wheels prevent slipage, so that a predetermined relationship between rollers will be retained.

Driven rotation of the upper feed roller 11 may be accomplished by the provision of a gear 76 on the shaft 63 of the rollers 12 exteriorly of the mounting plate 46 and a meshing like gear 77 on the axle of feed roller 11.

Figure 5:
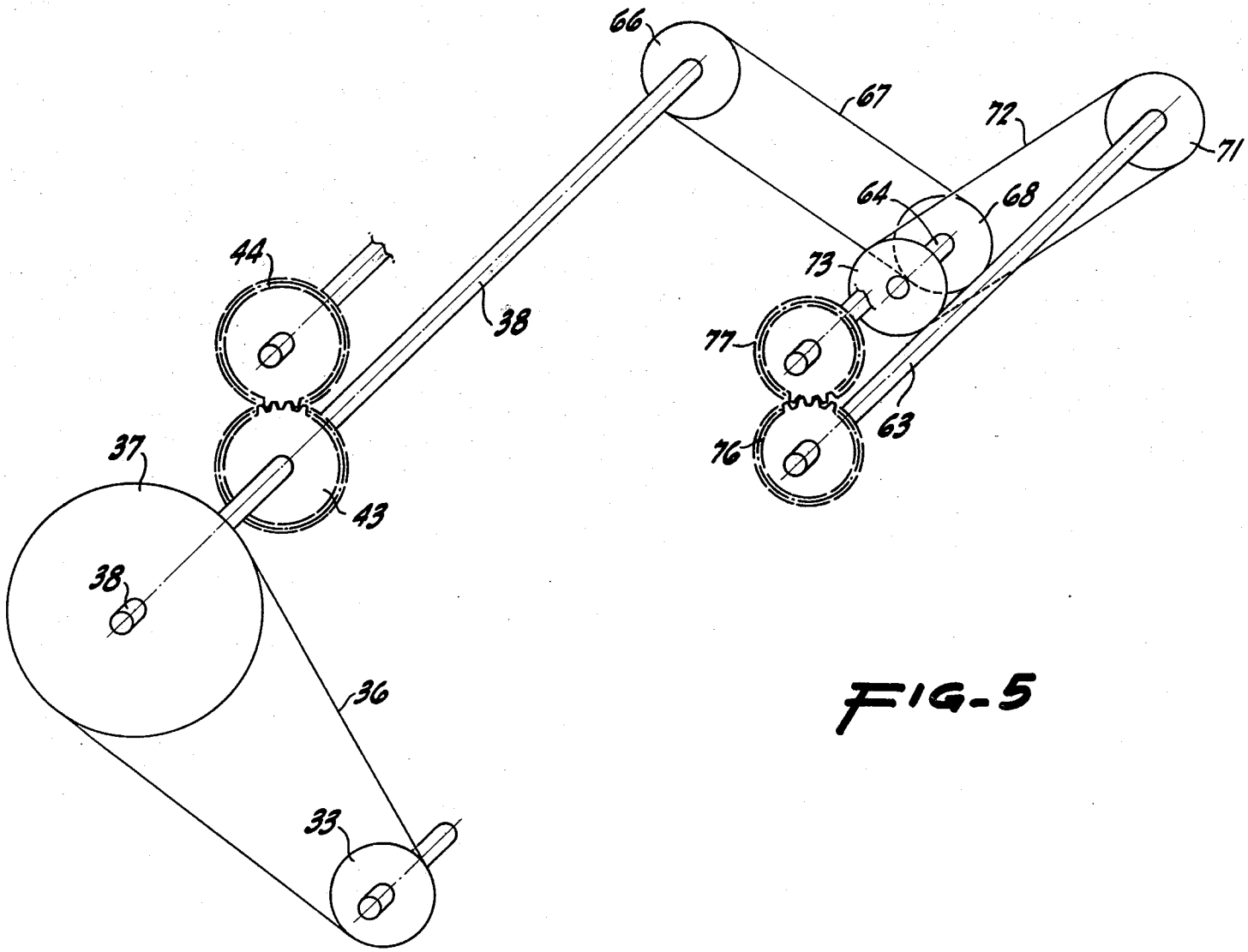
FIG. 5 is an exploded partial schematic perspective of the drive train and rollers of the present invention.

The drive train of the present invention is schematically illustrated in FIG. 5 wherein the drive motor 31 will be seen to rotate the pulley wheel 37 for rotating the drive roller 14 which is connected through gears 43 and 44 to drive the draw roller 13. The gear 44 has a smaller pitch diameter than that of gear 43 so that the rollers 13 and 14 are rotated with the same peripheral velocity. Belts 67 and 72 rotate the pulley wheel 71 from the pulley wheel 66 on the roller 14 through the intermediate pulley wheels 68 and 73 to thus rotate the feed roller 12 which is connected through like gears 76 and 77 to rotate the upper feed roller 11. The rollers 11, 12 and 14 are rotated at the same rate by the above-described drive system. The gears 43 and 44 have different pitch diameters equal to the different diameters of the rollers 13 and 14 to which they are attached. Thus roller 13 is rotated enough faster than roller 14 to cause the rollers to engage in rolling contact. Consequently, the draw rollers 13 and 14 are rotated with a greater peripheral velocity than the feed rollers 11 and 12 so as to apply a bursting force to a web gripped by the feed and draw rollers. The rollers 12 and 14 with flats thereon are, however, rotated in synchronism. It is also noted that the pulley wheels 66, 68, 73 and 71, all have the same diameters, and furthermore, the two belts 67 and 72 are identical, so that one revolution of the draw roller 14 will produce one revolution of the feed roller 12 that, in turn, produces one revolution of the feed roller 11. The pivot links 61 and 62 are also identical so that changing the distance between the feed rollers and the draw rollers can only produce identical angular displacement of all rollers whereby the relationship of the flat surfaces on the rollers 12 and 14 remains the same. This then insures that the present invention provides for the release of the web by the feed rollers at the same time that the flat surface on the draw roller is positioned so that the draw rollers do not grip the leading edge of the web. Consequently, the present invention does not cause misalignment of the perforation line across the web with the breaking element.

It is noted that the flat surface on the larger draw roller(s) is to be made of a larger size than the flat surface on the feed roller. Thus, in the example set forth above wherein the roller 14 may have a diameter that is 1.5 times the diameter of the feed rollers, the length of the flat surface on the roller 14 should be 1.5 times the length of the flat surface on the feed roller. Considering a further example of the roller 14 having a circumference of 9" and the feed roller having a circumference of 6", it is appropriate to provide a flat surface having a length of 1-$\frac{1}{8}$" on the roller 14, and a flat surface having a length of $\frac{3}{4}$" on the roller 12.

The present invention provides an improved and simplified manner of bursting forms or the like from a continuous web or stationery. By the use of the improved breaking element of the above-noted patent application, it is possible to burst the web without applying as much force to the end of the web. Thus, rather than attempting to pull the end of the web at a rate that is about two times the rate of normal web travel from the feed rollers, it is possible to pull the end of the web at only about one and half times its rate or somewhat less then one and a half times. This then provides for materially reducing the noise level of bursting, particularly, at high rates of bursting. The present invention provides a material improvement in this respect by the provision of wholly alternative means for achieving the acceleration of the leading edge of the web. In accordance with the present invention, a large draw roller is rotated at the same rate as the feed rollers, and a more rapid movement of the end of the web is achieved by this increased diameter of the large draw roller. With the large draw roller rotated at the same rate, i.e., the same r.p.m. as the feed rollers, it is possible, in accordance of the present invention to provide a simple drive train while yet maintaining alignment of flat surfaces on the pairs of rollers of the burster. This materially reduces the cost and complexity of the burster and improves the reliability and longevity thereof.

The present invention has been described above as to a single preferred embodiment thereof, however, it will be apparent to those skilled in the art that numerous modifications and variations are possible within the scope of the present invention, and consequently, it is not intended to limit the present invention to the details of illustration nor terms of description.

What is claimed is:

1. An improved burster having a first pair of feed rollers and a second pair of draw rollers spaced from said feed rollers with breaking means disposed between said pairs of rollers comprising at least one of said draw rollers having a diameter that is greater than the diameter of said feed rollers, drive means rotating said feed rollers and said larger diameter draw roller at the same rate of rotation for gripping and rapidly moving the leading edge of a web of paper away from said feed rollers to burst the web at said breaking means, means mounting said pairs of rollers for adjustable separation of said pairs to separate forms of different lengths from a continuous web thereof, said drive means including a pair of like links, each of said links at one end being pivotally connected to the other of said links, a double pulley wheel, the axis of said double pulley wheel coinciding with the axis of pivot connection between said links, at least one roller of each of said first and second pairs of rollers having a shaft, each of said shafts having the outer end of one of said links pivotally mounted thereon, a pulley wheel on each of said shafts, and a belt connecting said double pulley wheel to each of said pulley wheels on said shaft.

2. The burster of claim 1 further defined by one of said draw rollers having a greater diameter than the diameter of said feed rollers.

3. The burster of claim 2 in which one of said feed rollers and said larger diameter draw roller have flat surfaces thereon further defined by the flat surface on said larger draw roller having a length measured transversely of the length of the roller that is as much greater than the length of the flat surface on the feed roller as the diameter of the one draw roller is greater than the diameter of the feed roller.

* * * * *